United States Patent [19]

Sprick

[11] Patent Number: 4,527,854

[45] Date of Patent: Jul. 9, 1985

[54] METHOD AND APPARATUS FOR CONNECTING BRANCH CIRCUITS TO CORES OF A LIVE ELECTRICAL CABLE

[75] Inventor: Theo Sprick, Munich, Fed. Rep. of Germany

[73] Assignee: Preformed Line Products Company, Mayfield Village, Ohio

[21] Appl. No.: 501,768

[22] Filed: Jun. 7, 1983

[30] Foreign Application Priority Data

Jun. 7, 1983 [DE] Fed. Rep. of Germany ..... 3221458

[51] Int. Cl.[3] ..... H01R 13/38

[52] U.S. Cl. ..... 339/98

[58] Field of Search ..... 339/98, 263, 264, 265, 339/272

[56] References Cited

FOREIGN PATENT DOCUMENTS

| | | | |
|---|---|---|---|
| 1816810 | 9/1970 | Fed. Rep. of Germany | 339/98 |
| 2034976 | 1/1972 | Fed. Rep. of Germany | 339/98 |
| 2143219 | 3/1973 | Fed. Rep. of Germany | 339/98 |

*Primary Examiner*—Joseph H. McGlynn
*Attorney, Agent, or Firm*—Fay & Sharpe

[57] ABSTRACT

Method and apparatus for connecting branch circuits to cores of a live electrical cable include placing a plurality of contact pieces individually in position in a common predetermined cable cross-sectional plane. The branch circuits may be connected to the contact pieces before or after such placement. The contact pieces each have contact feet which include contact blades or like arrangements. The contact feet can be inserted into a dual trough-like spacer piece placed between the cable cores. A multi-piece clamping ring maintained in an assembled condition by tension bolts is positioned to enclose or envelop the contact pieces. During the process of tightening the tension bolts, pressure pieces exert pressure on the cable cores so that the cores are pressed against the adjacent contact pieces. This results in the contact blades penetrating the core insulation to establish physical contact with the cable.

16 Claims, 2 Drawing Figures

METHOD AND APPARATUS FOR CONNECTING BRANCH CIRCUITS TO CORES OF A LIVE ELECTRICAL CABLE

BACKGROUND AND SUMMARY OF THE INVENTION

The present invention is generally related to a method and apparatus for connecting electrical circuits. More specifically, the present invention is related to a method and apparatus for connecting branch circuits to cores of a live electrical cable.

From the previously known German Pat. No. DE-GM-1 855 753, a known branch terminal for a ground cable exhibits two semi-circular shaped insulation bodies. Contact pieces including lugs having a conical or pyramid shape are implanted in the interior of the insulation bodies. The insulation parts are pressed together by a tension band extending around a circumferential groove in the insulation parts. A disadvantage of this arrangement is that the connection of the branch terminals is not possible at the individual contact pieces, separated from the insulation bodies. Thus, because of the required bending and insertion of branch conductors into the openings of the contact pieces, the connection of the branch circuits becomes more difficult. In addition, the exertion of pressure upon the contact pieces and the pressing of the contact piece protrusions into the cable cores requires massive upper and lower parts, thus resulting in an unnecessary manufacturing cost. Finally, the pressing of the radial contact piece protrusions during the process of pressing together the two-part insulation body is not efficient.

From the prepublication version of German Patent Document No. DE-PS-1 765 242 it is furthermore known that a branch terminal can be provided with a two-part clamping body whose two parts are kept flexible with respect to each other and which can be pressed together by the use of bolts. The clamping body parts accept the contact pieces firmly. They thus transmit to the contact pieces the pressure generated as a result of the tightening operation, and press the blades of the contact pieces, which extend in the direction of the approaching clamp body parts, into the cable cores. It is a disadvantage of this known branch terminal that the connection of the branch conductors is only possible at the contact pieces which are located within the clamp body. This makes the connection of the branch conductor more difficult. Moreover, the clamp body in this instance, due to the transfer of pressure on the contact pieces, must also consist of compact parts which are expensive to produce.

The invention is based on the objective of facilitating the connection of branch conductors to the contact pieces and simplifying the production and manufacture of the clamp body.

The invention achieves this objective with the characteristic properties which are more fully described in the specification.

One advantage of the invention is that it makes possible the connection of branch conductors, even singly, to the spatially separated contact pieces of the branch terminal. The installation process is thereby simplified considerably.

Moreover, it is possible to use a relatively simple body for pressing together the cable cores and thus, for compressing the contact blades or similar elements of the contact pieces into the cable cores.

The clamping ring, which exerts pressure only upon the cable cores, can be made from a metallic part, preferably a pressed metal ring, which is bent into a U-shaped element.

Additional advantages of the invention are evident from the following detailed description.

BRIEF DESCRIPTION OF THE DRAWING

The invention may take physical form in certain parts and arrangements of parts, a preferred embodiment of which will be described in detail in the specification and shown in the accompanying drawings which form a part hereof and wherein.

DETAILED DESCRIPTION OF THE PREFERRED EMBODIMENT

Figure 1:
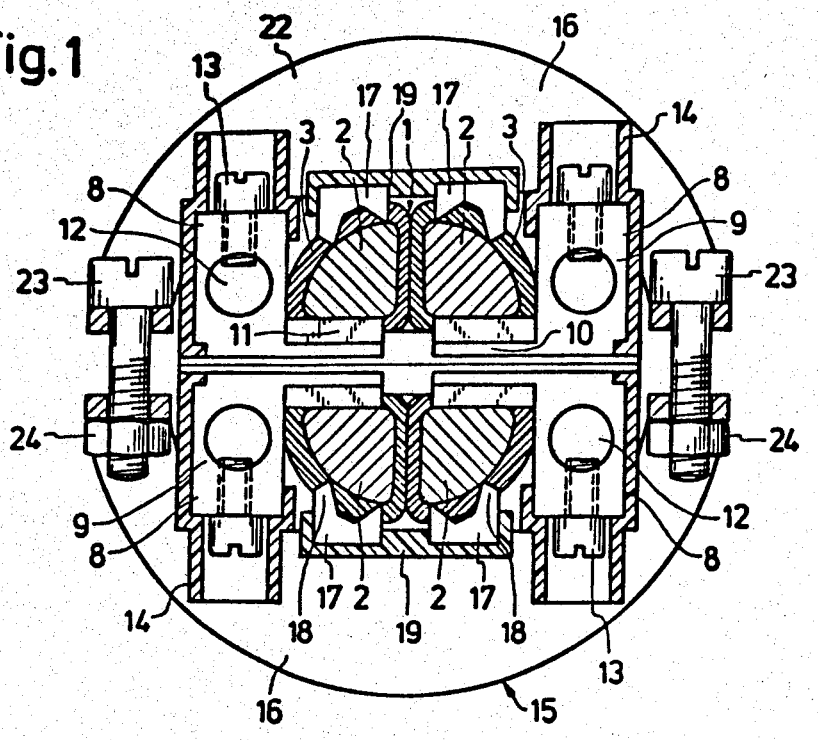
FIG. 1 is a front view, partially sectioned, of the branch terminal, according to the invention; and, FIG. 2 is a side view of the branch terminal of FIG. 1.

With reference to the drawings, wherein showings are for purposes of illustrating a preferred embodiment of the invention only and not for purposes of limiting the same, FIG. 1 shows a main cable 1 including four cable cores 2. These preferably have the cross-sectional shape of a circle segment. Each cable core 2 is surrounded by insulation 3. The external insulation sheathing which encases the main cable has already been removed in the illustration.

The two uppermost cable cores 2, as shown in FIG. 1, have been separated from the lower cable cores by inserting a spreader wedge or other spreader device, thus resulting in the separated position as illustrated. A spacer element 5, which traverses the main cable 1, is inserted into the slot 4 produced between the upper and lower cable cores. The spacer element 5, as evident from FIG. 2, exhibits a dual trough-shaped profile, when viewed in cross-section. It is produced by squaring off a corresponding profile section. From the rail 6 extend edges 7 on each side, sloping in an upward or downward direction toward the outside. The sloping edges 7, when placed under increased pressure on their sides, can bend in the direction of the plane or rail 6.

Four contact pieces 8 for the four cable cores 2 are identically shaped. They have a block-shaped contact piece body 9, which is joined by a one-piece contact foot 10 located at a right angle to the longitudinal axis of the contact piece body. The free length of this foot is dimensioned so that it extends at least over a substantial portion of the cable core 2 when the contact pieces rest upon the cable core 2. The contact foot 10 preferably has contact blades 11, but may also have contact points, etc. The contact blades 11 extend in the longitudinal direction of the foot 10.

The contact pieces 8 may be inserted with their feet into the space limited by the spacer 5 and each respective cable core 2. The height of each contact foot 10 is preferably equal to the projection height of the edges 7 of the spacer 5. However, it may also be somewhat higher or lower. If it is a little bit higher, the contact pieces 8 are inserted under pressure, inasmuch as contact blades 11 already penetrate to some extent the insulation 3 of each cable core. Consequently, following insertion of the contact pieces, the contact pieces are secured against slipping out of position. If all four contact pieces 8 have been properly inserted into the spacer piece 5, the lateral surfaces of contact piece body 9, which are facing the main cable 1, are in contact with the insulation 3 of the respective cable core 2.

Each contact piece body 9 has a crosswise connection hole or opening 12 for a branch conductor (not illustrated) which is to be connected. At the center and along the longitudinal axis of the contact piece body 9 there is a clamp screw 13 for clamping down a branch conductor (not illustrated).

Each contact piece body 9 is surrounded by an insulating jacket 14. This jacket is designed so as to protrude above the head of clamping screw 13 with a closed cross-section and from that point extends to each outer surface of the contact piece 8 up to the lower extremity of the contact piece body 9. This lower extremity of the insulation jacket 14 projects inwardly and thus affords protection against unintentional removal of the insulation jacket 14. The lateral surfaces of the contact piece 8 which face each other, along with a section of the lateral surface of contact piece 8 which faces the core cable 2, are free of insulation.

The connection of the branch conductor to the contact pieces 8 is preferably achieved before the latter are inserted with their feet 10 into the spacer piece located between the cable cores 2. However, it is also possible to make the connection of the branch conductors after the contact pieces have been inserted, when the latter have in essence been positioned in a common cross-sectional plane of the main cable 1.

In order to make physical contact between the contact blades 11 and the cable cores 2, it is necessary for the cable cores 2 to be pressed with great pressure against the contact blades 11.

Figure 2:
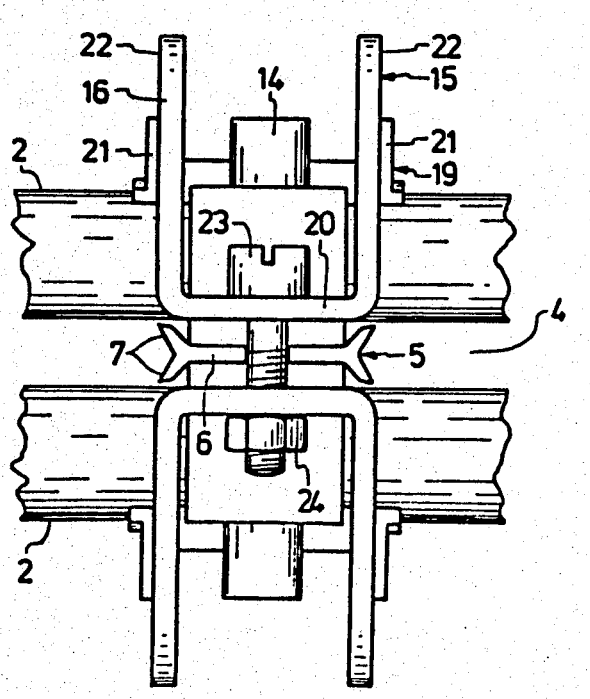

To this end, a two-part clamping ring 15 is preferably used. The clamping ring 15 preferably includes two semicircular parts 16. Each part 16 is shaped like a "U" when viewed from its cross-section (FIG. 2). In the apex area, pressure pieces 17 having teeth or blades 18 are located next to one another and are supported by a first insulation element 19 against the U-rail 20, which passes through the apex area. The second insulation elements 21, which encase the lateral walls of the semicircular part 16, are designed for the attachment of the first insulation element 19.

In the area of contact pieces 8, the U-rails 20 are recessed so that the contact piece bodies 9 with the insulation casing 14 can freely pass through.

The extremities of the part 16 exhibit in the U-rails 20 holes for the mounting of tension bolts 23 with nuts 24.

In operation, the contact pieces 8 are positioned on the main cable 1 by inserting the contact feet 10 into the spacer piece 5, which extends crosswise through the main cable 1. After connecting the branch conductors to the contact pieces 8, the clamping ring 15 is positioned and, as a result of tightening the tension bolts 23 by means of the pressure pieces 17, pressure is exerted so that the cable cores 2 are pressed against the blades 11 of the contact feet 10. The contact blades 11 then penetrate the insulation 3 and make physical contact with the metal core of cable cores 2. Since connection of the branch conductors occurs before physical contact is established between the contact pieces 8 and the cable cores 2, no special tools are required for connecting the branch conductors. Since the live voltage-carrying components are completely and safely insulated from the metallic clamping ring 15, likewise no special tools are needed for tightening the tension bolts 23.

The spacer element 5 may also take the shape of a wedge, which thus helps to spread apart the cable cores 2 and which, after insertion of the spacer element, projects above the main cable 1. This projecting piece of the wedge, which is no longer required, may be sawed or broken off (if the necessary break groove is provided).

It is also possible to design the contact piece 8 and the spacer piece 5 in such a way that after the insertion of the contact piece foot 10 into the spacer piece 5, the contact piece 8 is locked into place. To this end, for example, it would be possible to design the top side of the rail 6 and the bottom side of the contact foot 10 with teeth. Thus, it is possible to insert the contact piece foot 10 into the spacer piece 5, thereby preventing it from being removed.

Instead of a metallic clamping ring 15, it is also possible to utilize a clamping ring made from insulation material. In this instance, the metal pressure pieces 17 and the insulation elements or insulation jackets which surround and/or support the contact pieces 8 can be eliminated.

Although the invention has been shown and described with reference to the preferred embodiment, it is obvious that alterations and modifications will occur to others upon a reading and understanding of this specification. The invention includes all such alterations and modifications insofar as they come within the scope of the claims or the equivalents thereof.

Having thus described the invention, it is now claimed:

1. A method for electrically connecting at least one branch circuit to a live electrical cable having a plurality of cores, comprising:

spreading apart the plurality of cores of the cable to form an open area between the cores;

inserting contact means in the open area between the plurality of cores;

connecting the at least one branch circuit to the contact means;

encircling the plurality of cores and the contact means with clamping means; and, tightening the clamping means to press the plurality of cores against the contact means thereby connecting the at least one branch circuit to at least one of the plurality of cores of the cable.

2. The method of claim 1 wherein the step of spreading includes placing a spacer element in the open area between the cores to keep them apart and wherein the contact means includes a plurality of contact pieces which are located in a planar open area between the plurality of cores during the step of inserting.

3. The method of claim 1 wherein during the step of tightening, a knife edge blade of the contact means progressively cuts through an insulation layer surrounding at least one of the plurality of cores of the cable, said tightening step continuing at least until the knife edge blade electrically connects the at least one branch circuit to the at least one core of the cable.

4. Apparatus for electrically connecting at least one branch circuit to an electrical cable having a plurality of cable cores, comprising:

at least one contact piece having a foot-shaped extension which is insertable between at least first and second cable cores and with a branch circuit lead being connected to said at least one contact piece; and, clamping means selectively clampable around the electrical cable and the at least one contact piece and including means for bringing the at least one contact piece with the at least one branch circuit into electrical contact with the cable.

5. The apparatus of claim 4 wherein the foot-shaped extension of the contact piece has flat edge surfaces and wherein a contact blade for contacting a cable core is supported along a longitudinal edge of the foot-shaped extension.

6. The apparatus of claim 4 wherein the contact piece includes a clamping aperture in which a lead from the branch circuit is positioned, and clamping means for clamping the lead to the contact piece.

7. The apparatus of claim 4 wherein the clamping means includes a clamping ring having two semi-circular halves which are joined by fastening means, each said half having a generally U-shaped cross-section which receives an internally insulated pressure piece and has recesses for the unrestricted passage of the at least one contact piece.

8. The apparatus of claim 4 further including spacing means for spacing apart the first and second cable cores so that the contact piece can be inserted therebetween.

9. The apparatus of claim 8 wherein the spacing means includes a rail-shaped spacer element having a dual trough-shaped profile and longitudinal edges of a size approximately the same as the width of the foot-shaped extension of the contact piece.

10. The apparatus of claim 9 wherein the longitudinal edges of the spacer element extend obliquely outward.

11. The apparatus of claim 9 wherein the spacer element has a wedge-shaped front portion.

12. The apparatus of claim 9 wherein the spacer element cooperates with the contact piece such that in one position of the contact piece the spacer element is locked in place.

13. A branch terminal for electrically connecting at least one branch circuit to an electrical cable having a plurality of cable cores wherein each core is surrounded by insulation, comprising:

a spacer body which spaces at least first and second cable cores apart from each other;

at least one contact piece having a block-shaped contact piece body and a foot-shaped extension perpendicular thereto, said contact piece body including connecting means for connecting the at least one branch circuit to the contact piece and said extension including a knife blade contact portion; and, a clamping ring having two generally semi-circular halves wherein the clamping ring is selectively clampable circumferentially of the plurality of cable cores and around the contact piece and the spacer body, said clamping ring including means for adjusting the relative spacing between said halves for urging the knife blade contact portion of the contact piece to cut through the insulation of at least one of the plurality of cable cores thereby electrically connecting the branch circuit with the electrical cable.

14. The branch terminal of claim 13 wherein the spacer body is rail-shaped and has outwardly flaring longitudinal edge portions.

15. The branch terminal of claim 13 wherein the contact piece body of the contact piece is surrounded by an insulating jacket and the foot-shaped extension of the contact piece body is free of insulation.

16. The branch terminal of claim 13 wherein the connecting means of the contact piece includes an aperture in the contact piece body for receiving the branch circuit and a clamping means which can selectively clamp the leads of the branch circuit to electrically connect the branch circuit to the contact piece.

* * * * *